US006174220B1

(12) United States Patent
Stametz et al.

(10) Patent No.: US 6,174,220 B1
(45) Date of Patent: Jan. 16, 2001

(54) METHOD OF MANUFACTURING SURGICAL NEEDLES HAVING BLUNT TIPS

(76) Inventors: Jerry W. Stametz, 357 Chestnut St., Freemonsburg, PA (US) 18017; William C. McJames, 11 Evergreen Ct., Belle Mead, NJ (US) 08502; Eric W. Hinrichs, 366 Cafferty Rd., Pipersville, PA (US) 18947; Craig S. Matthews, 61 Barnes Ct., Perth Amboy, NJ (US) 08861

( * ) Notice: Under 35 U.S.C. 154(b), the term of this patent shall be extended for 0 days.

(21) Appl. No.: 09/480,099

(22) Filed: Jan. 10, 2000

Related U.S. Application Data

(63) Continuation-in-part of application No. 09/285,600, filed on Apr. 2, 1999, now abandoned.

(51) Int. Cl.[7] ..... B24B 1/00

(52) U.S. Cl. ..... 451/35; 451/36; 451/327; 451/329; 451/330

(58) Field of Search ..... 451/35, 28, 36, 451/34, 32, 33, 326, 327, 328, 329, 330; 606/223, 222

(56) References Cited

U.S. PATENT DOCUMENTS 5,419,735 * 5/1995 Imahashi et al. ..... 451/35
5,601,475 * 2/1997 Stametz et al. ..... 451/35
5,611,725 * 3/1997 Imahashi ..... 451/104

* cited by examiner

*Primary Examiner*—Derris H. Banks
(74) *Attorney, Agent, or Firm*—Emil Richard Skula

(57) ABSTRACT

A method of manufacturing blunt tip surgical needles. Taper point needles having conventional piercing tips are placed into a vessel containing a grinding media. The needles are maintained in the vessel for a sufficient amount of time to convert the piercing point into a blunt. Additionally, the needles may be separated from the grinding media using a rotating magnetic drum such that the needles remain engaged with the magnetic drum while the grinding media is directed away to a collection tray. Needles are later removed from the magnetic drum.

6 Claims, 4 Drawing Sheets

METHOD OF MANUFACTURING SURGICAL NEEDLES HAVING BLUNT TIPS

This is a Continuation-in-Part of patent application Ser. No. 09/285,600 filed on Apr. 2, 1999 now abandoned.

TECHNICAL FIELD

The field of art to which this invention pertains is surgical needles, more specifically taper point surgical needles having blunt tips.

BACKGROUND OF THE INVENTION

Blunt tip needles have been found to be effective tools in the on-going battle to control the spread of infectious agents borne in body fluids when used in a generally recognized control program including the use of double gloves, appropriate protective clothing and face shields, appropriate needle packaging, and special packing and disposal techniques for used needles. It is widely known that infectious bacterial and viral diseases such as H.I.V., hepatitis, various venereal diseases, etc., can be spread through contact with the body fluids of infected individuals. The Occupational Health & Safety Administration (O.S.H.A.) has recently promulgated regulations governing the exposure of workers to infectious agents. The regulations are concerned, in part, with the transmission of infectious agents by puncture wounds or cuts from various sharp medical devices which have been contaminated with body fluids potentially containing infectious agents, e.g., hypodermic needles, catheters, etc.

It is known that a surgeon during the course of a major operation may sustain one or more needle sticks when suturing with a surgical needle. In addition, support personnel are also exposed to potential needle sticks when handling surgical needles having sharp piercing points.

Blunt tip surgical needles were developed over thirty years ago for use with certain friable tissue, such as the kidney. More recently, their use to prevent needle sticks as part of a multi-faceted program to prevent the spread of infectious agents has become accepted in the medical field. The blunt tip needles of the prior art, however, were known to have problems penetrating through tough tissues and could only be used on certain types of soft tissues.

As previously mentioned, there is a heightened concern regarding the spread of infectious diseases caused by contact with infectious body fluids. Consequently, the medical community has now demanded that surgical needle manufacturers supply blunt tip needles useful in many types of tissue (in addition to friable tissue) as part of their infectious disease control programs. In order to provide blunt tip taper point needles which approach the penetration characteristics of conventional taper point needles (having sharp piercing tips) and which have utility on various types of tissue, it has been necessary to decrease the radius of the points of blunt tip needles. However, it is known that such blunt tip needles having improved tissue piercing characteristics are difficult to manufacture compared to conventional blunt tip needles which are designed for use with friable tissue.

Blunt tip surgical needles are manufactured using several conventional processes, for example, a lathe-type process. In such processes, a conventional wire is cut into blanks which are fed into a lathe, screw machine or similar apparatus. A tool spins or orbits about the distal end of each wire blank to form a blunt end or tip having a desired profile. However, it is known that conventional blunt tip manufacturing processes have several deficiencies. A major deficiency relates to dimensional instability. This is believed to be caused, at least in part, by the cutting tools wearing out rapidly. This condition worsens when cutting blunt tip needles having smaller tip radii. For example, two cutting tools are conventionally used in a particular conventional blunt tip needle manufacturing process. One tool forms the proximal section of the taper, and one tool forms the distal, blunt profile, piercing tip. It is possible for the two cutting tools to be out of synchronization resulting in the manufacture of needles having out of specification needle and tip profiles. Yet another deficiency associated with conventional blunt tip manufacturing processes relates to the limitation on the types of alloys which can be processed with conventional cutting tools. In particular, it is known that hard alloys wear out cutting tools very quickly. Still yet another deficiency associated with existing blunt tip manufacturing processes is the slow throughput of machinery used in such processes when compared with conventional sharp taper point needle manufacturing processes.

Therefore, what is needed in this art is a process for manufacturing blunt tip needles which is efficient and economical, which reduces dimensional variability, which can be readily used on a multitude of alloys, and which eliminates the need for cutting tools to produce blunt tips.

DISCLOSURE OF THE INVENTION

Accordingly, it is an object of the present invention to provide a novel process for manufacturing blunt point surgical needles.

It is a further object of the present invention to provide a process for the manufacture of blunt tip surgical needles in which the dimensions of the blunt tips can be precisely monitored and controlled in a reproducible manner.

It is yet a further object of the present invention to provide a method of manufacturing blunt tip needles having tip configurations which cannot be readily made using conventional manufacturing processes.

It is still yet a further object of the present invention to provide a process for manufacturing blunt tip needles having improved efficiency.

Yet another object of the present invention is to provide a process for manufacturing blunt tip needles which can be used on a wide variety of alloys.

Still yet another object of the present invention is a process for manufacturing blunt tip needles which eliminates the need for conventional cutting tools to produce a blunt tip.

Accordingly, a novel process for manufacturing blunt tip surgical needles is disclosed. The process comprises the steps of initially placing surgical needles having conventional, sharp taper points, or if desired, semi-finished taper needle blanks with truncated tips, into an apparatus having a vessel which is capable of displacement, preferably rotation, wherein the vessel contains an abrasive or grinding media. The vessel is then displaced, e.g., rotated, to cause the abrasive or grinding media to contact the needles for a sufficient amount of time to effectively convert the taper points, or truncated points, to blunt tips having a desired configuration.

Yet another aspect of the present invention is a blunt tip surgical needle manufactured by the previously-described method.

Still yet another aspect of the present invention is a novel process for manufacturing blunt tip surgical needles. The process comprises the steps of initially placing surgical needles having conventional, sharp-taper points, or if desired, semi-finished tapered needle blanks with truncated tips, into an apparatus having a vessel which is capable of displacement, preferable rotation, wherein the vessel contains an abrasive or grinding media. The vessel is then displaced, e.g., rotated, to cause the abrasive or grinding media to contact the needles for sufficient amount of time to effectively convert the taper points, or truncated points to blunt tips having a desired configuration. Then, the needles are separated from the abrasive or grinding media using a member having a magnetic surface. The magnetic surface is preferably cylindrical and more preferably rotatable to facilitate the separation process. The magnetic surface of the rotating member engages the needles, thereby separating the needles from the abrasive media. Then, the needles are disengaged from the surface of the rotating member. Preferably the rotating member is a hollow drum.

Other features and advantages of the invention will become more apparent from the following description and accompanying drawings.

BEST MODE FOR CARRYING OUT THE INVENTION

Surgical needles typically consist of an elongated shaft having a proximal suture mounting portion and a distal piercing point. Surgical needles are typically classified as either taper-point needles, wherein the diameter of the shaft tapers to a piercing point, or cutting edge needles, wherein the needles have various cutting edges along with a piercing point to assist in penetrating various types of tissue. A conventional process for manufacturing a taper point needle having a sharp piercing point typically consists of initially cutting wire into needle blanks. Each needle blank is then subjected to a series of grinding operations. These operations may be conventionally performed in the following manner. The needle blanks are fed into a conventional belt/stone grinding machine where they are given a sharp distal piercing tip. The needles are then transported individually or in bulk to a conventional needle drilling station wherein the needles are drilled using conventional carbide or tool steel drill bits to provide a proximal suture mounting cavity. If desired, the mounting cavity may by laser drilled, or alternatively, a longitudinal channel may be formed in the distal end of the needle for suture mounting. The needles are then typically degreased and moved in bulk to a conventional belt/stone grinding machine for a finish taper grind and then to a curving machine to produce a conventional curved configuration. The needles are then cleaned, heat treated and may be electrochemically treated to additionally finish the needles.

Blunt tip needles are conventionally made in a similar manner. However, rather than grinding the distal tip, a lathe type process is used instead to produce a blunt tip having a desired blunt profile.

The term "taper point" as used herein is defined to mean the distal end of a surgical needle having a taper profile which tapers from a maximum dimension to a distal minimum, wherein the distal point forms a piercing point.

The terms "abrasive" and "grinding" are used interchangeably herein and are defined to describe the process of mechanically removing metal from a part or object by contacting the part or object with a media. A grinding or abrasive media is defined to mean a composition or a plurality of objects, particularly shaped objects, which will cause the mechanical removal of material from a part or object when forcibly contacted therewith.

Figure 1:
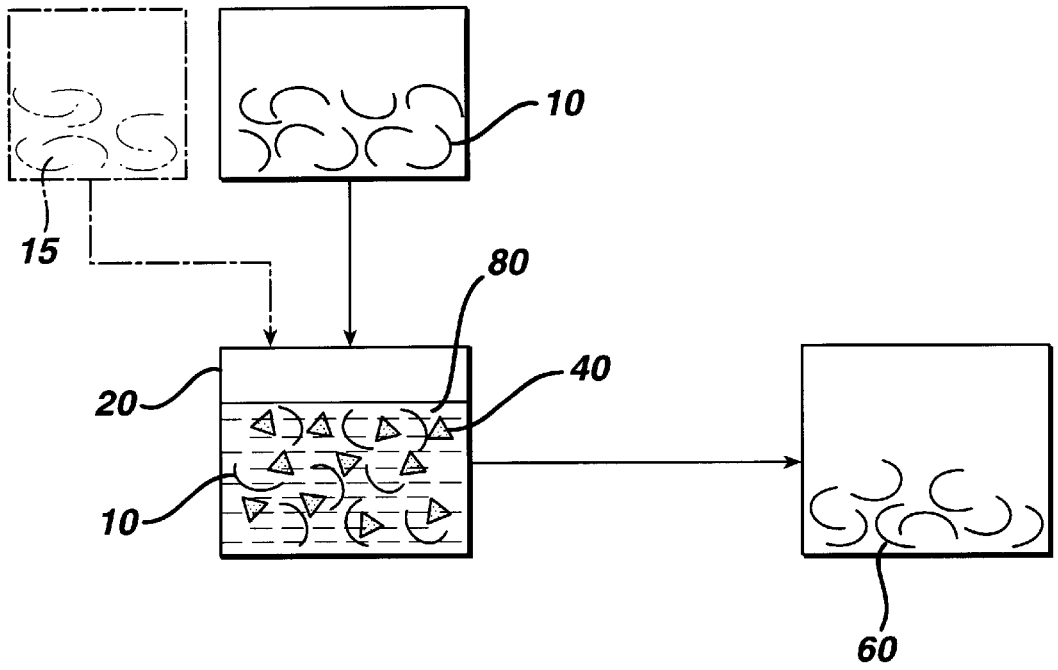
FIG. 1 is a flow diagram of a blunt tip manufacturing process of the present invention.
Figure 4:
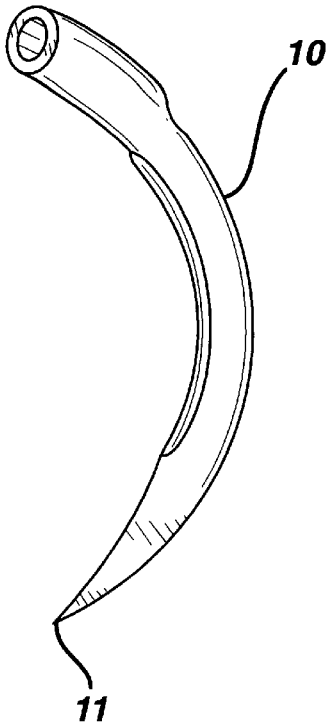
FIG. 4 is a perspective view of a taper point needle having a conventional, sharp piercing point.
Figure 5:
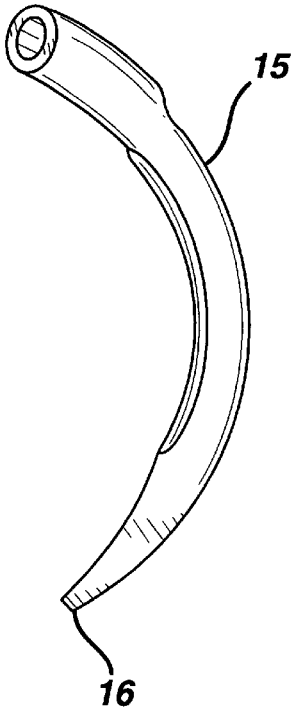
FIG. 5 is a perspective view of a taper point needle having a semi-finished truncated point.

A flow diagram of the process of the present invention is seen in FIG. 1. Taper point needles 10 having conventional sharp piercing distal points 11, or semi-finished, truncated taper needle blanks 15 having truncated tips 16, (see FIGS. 4 and 5) are loaded into grinding apparatus 20. The taper point needles 10 having sharp piercing points 11 may be manufactured by any conventional manufacturing process including the taper point manufacturing process previously mentioned above. The semi-finished, truncated needle blanks 15 having truncated ends 16 are manufactured by using a similar process to the taper point needle process with the exception that a secondary series of grinding operations are eliminated and the first series of grinding operations are adjusted to make the desired finished taper.

Figure 6:
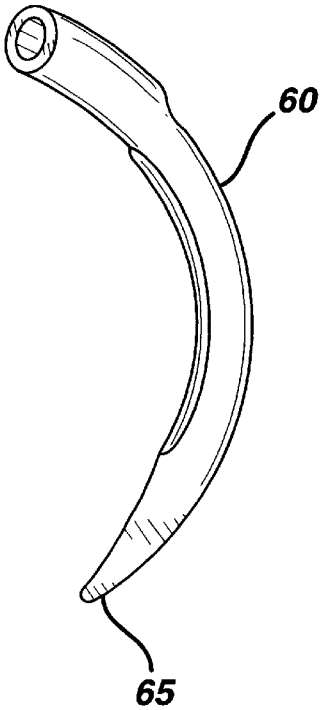
FIG. 6 is a perspective view of the taper point needle of FIG. 4 or the truncated needle blank of FIG. 5 after having been processed through the process of the present invention; the needle is seen to have a blunt tip.
Figure 7:
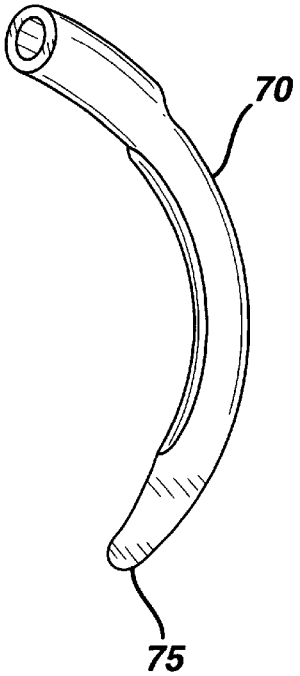
FIG. 7 PRIOR ART
FIG. 7 is a perspective view of a conventional blunt tip needle.

As illustrated in FIG. 1, the apparatus 20 is seen to contain abrasive media 40. Needles 10, or blanks 15, are charged to the apparatus 20. The apparatus 20 is mechanically displaced, e.g., rotated, vibrated, etc., such that needles 10 (or blanks 15) are contacted with the abrasive media 40 for a sufficient length of time to effectively produce blunt tip needles 60 (see FIG. 6). Typically, the processing or contact time may be about 1 to about 120 minutes, more typically about 5 to about 90 minutes, and preferably about 15 to about 60 minutes. It will be appreciated by those skilled in the art that the processing or contact time will depend upon a number of parameters, including the needle size, needle point geometry, the media size, type and geometry, and the size and configuration of the grinding apparatus, etc. When contacting the needles and abrasive media in the grinding apparatus, it is desirable to subject the needles to a "g" force sufficient to provide effective contact. The "g" force may typically range from about 1 to about 21, more typically about 10 to about 20, and preferably about 15 to about 17. A conventional blunt tip needle 70 having a conventional blunt tip 75 is seen in FIG. 7. The tip 75 is seen to have a larger radius or degree of bluntness. If desired, although not preferred, conventional blunt tip needles 70 having conventional blunt tips 75 can also be produced by the process of the present invention if desired.

Although not required, it is preferred to add sufficient amounts of processing aids 80 to the apparatus 20 to effectively assist in grinding or metal removal. The processing aids include those conventional in the art such as water, aluminum oxide powder, silicon carbide, polymers and the like. It will be appreciated that the amounts of processing aids utilized will vary with several parameters including the type and size of needles, the type, size, and geometry of abrasive media, the type and size of grinding apparatus, the desired blunt tip profile, the amount of metal which must be removed to produce the profile, the processing time, the "g" force, etc.

The grinding apparatuses 20 which can be used in the practice of the present invention include conventional grinding apparatuses such as ball mills, barrel tumbling mills, vibrator mixing apparatuses, orbital mixing apparatuses, and the like and equivalents thereof. It is particularly preferred to use orbital mixing apparatuses 100 such as that illustrated in FIG. 2. Apparatus 100 is seen to consist of multiple (e.g., six) rotating cylinders 110 containing needles 10, media 40, and processing aid 80 mounted to a counter-rotating, orbitally mounted plate 120. The apparatuses 20 will typically consist of a vessel for receiving the abrasive media and needles, and a mechanism for displacing the vessel. The vessel will be capable of displacement, preferably rotation, in a manner effective to provide sufficient contact between the needles and abrasive media. The vessel may be open during grinding, e.g., when using an apparatus such as an orbital mixing apparatus, or sealed during grinding, e.g., when using an apparatus such as a ball mill.

The abrasive media which can be used in the practice of the present invention include any media sufficient to effectively produce a blunt tip on taper point surgical needles (or truncated taper needle blanks) when the needles and media are tumbled in a grinding apparatus. Examples of abrasive media which can be used include aluminum oxide, flint stone, porcelain, quartz, metals, alloys, ceramics and the like and equivalents thereof.

Figure 3A:
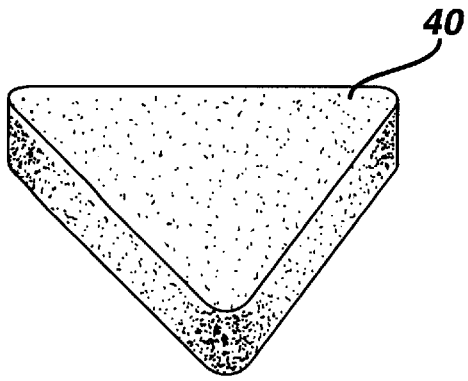
FIG. 3A is a perspective view of a grinding media useful in the process of the present invention having a triangular shape.
Figure 3B:
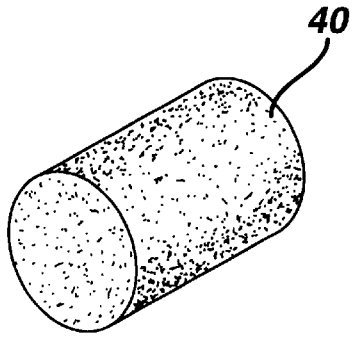
FIG. 3B is a perspective view of a grinding media useful in the process of the present invention having a cylindrical shape.
Figure 3C:
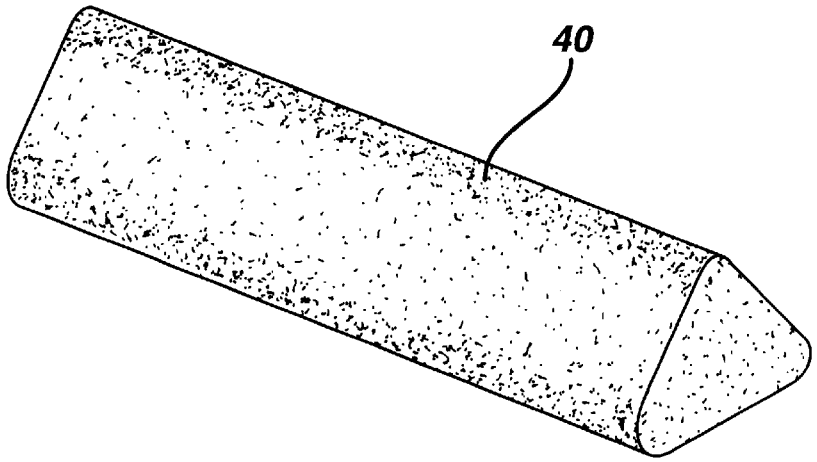
FIG. 3C is a perspective view of a grinding media useful in the practice of the present invention having a triangular cross-section.

The size of the grinding media will be effective to sufficiently convert a taper point piercing tip to a blunt tip. The grinding media, i.e., the members collectively making up the grinding media, may have any effective configuration including conventional configurations such as triangles, cylinders, cones, stars, spheres and the like and equivalents thereof and combinations thereof. It is particularly preferred to use grinding media having a triangular or cylindrical configuration as illustrated in FIGS. 3A, 3B and 3C. The size of the grinding media for a cubic triangular configuration as seen in FIG. 3A may typically be about 1"×1"×1" by ¼" thick to about 0.5"×0.5"×0.5" by ⅛" thick. The size of the grinding media for a cylindrical configuration seen in FIG. 3B may typically be about 1/16" radius ×¼" length to about ¼" radius by ½" length. The size of the grinding media for the elongated member having a triangular cross-section and rounded corners as illustrated in FIG. 3C may typically be about ⅛"×⅛"×⅛"×0.75".

The needles 60 of the present invention may be made from conventional materials including martensitic or austenitic stainless steels, plastics, composites, laminates, Nitinol and the like and equivalents thereof. It is particularly preferred to use Type 420 stainless steel.

The needles 60 manufactured by the process of the present invention will have a distal blunt tip 65 which will have a configuration which will typically vary in accordance with grinding time, e.g., a smaller radius with shorter processing times and a larger radius with longer processing times, although other factors may affect the grinding time necessary to achieve a desired radius as mentioned herein including metal type, media type, etc. The blunt tip 65 when ground for a shorter time may, for example, have a radius of about 0.002" to about 0.10", while the tip 65 when ground for a longer time may have a radius of about 0.010" to about 0.018". Of course, a variety of needle radii can be produced by the process of the present invention and the radius will also depend upon the type and size of needles used to manufacture the blunt tip needles 60, the degree of sharpness of the needle tips, etc. The radius of the blunt tip 65 will vary in accordance with several process parameters, as mentioned previously, including material of construction, type of grinding apparatus, needle wire size, grinding aids, "g" forces, grinding time, etc. Those skilled in the art will further appreciate that the process of the present invention can be used to produce needles 60 having a substantially flat tip 65 with substantially no radius.

Figure 8:
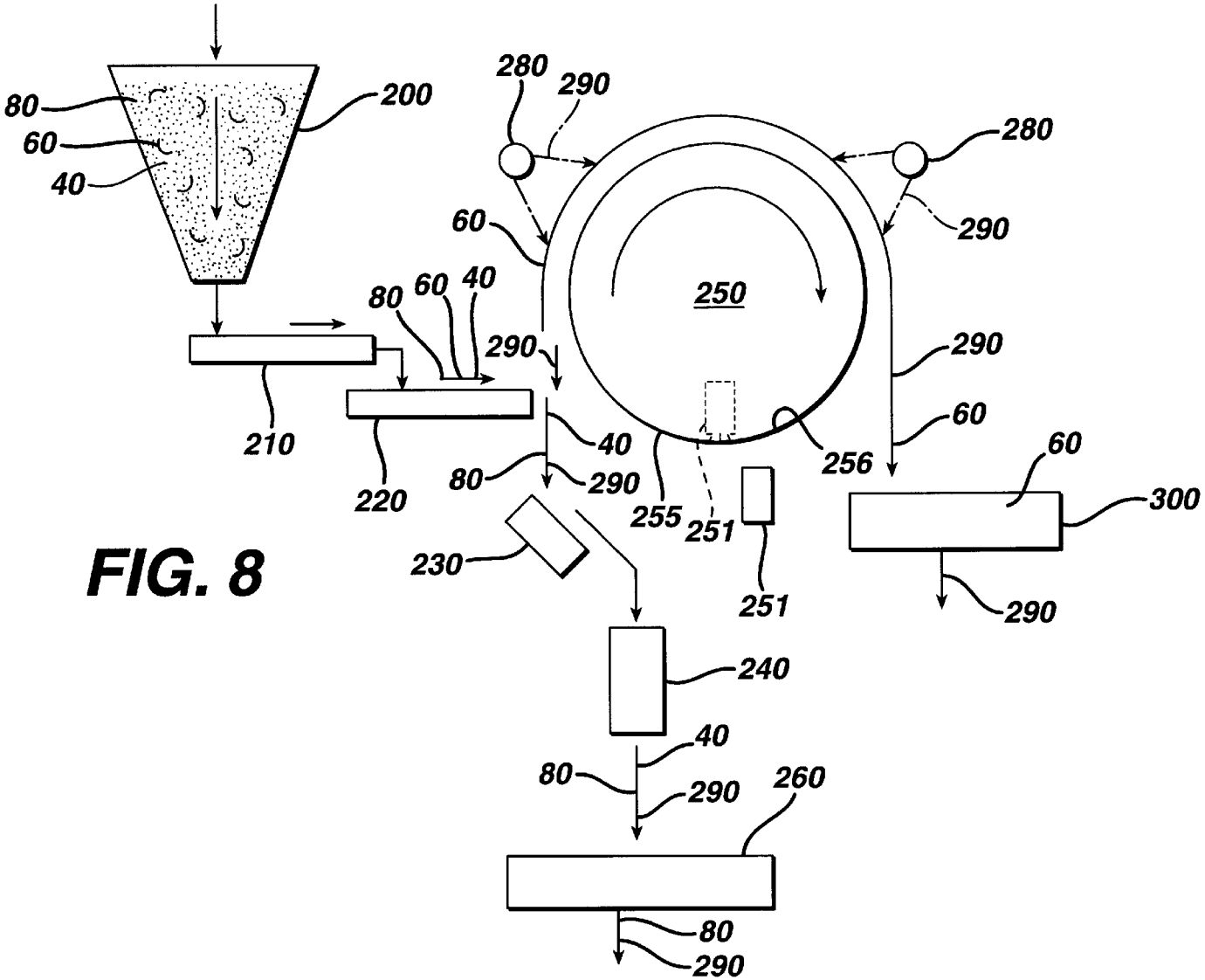
FIG. 8 is a flow diagram of a process of the present invention illustrating the separation step of the manufacturing process of the present invention wherein blunt tip needles are separated from the abrasive media.

Referring now to FIGS. 1 and 8, a separation process useful in the process of the present invention is illustrated. The finished blunt tip needles 60, abrasive media 40 and processing aids 80 are moved from apparatus 20 and loaded into conically shaped hopper 200. The needles 80, abrasive media 40 and processing aids 80 are then discharged in a metered fashion to conventional vibrating feeder 210. If desired, the needles 80, media 40 and processing aid 80 may then be transferred to a second optional vibratory feeder 220. Vibrating feeder 220 then feeds the needles 60, media 40 and processing aids 80 to the exterior surface of rotating drum 250. One skilled in the art will appreciate that the vibrating feeders can be replaced by equivalent known conventional material transfer means such as conveyor belts, etc. Rotating drum 250 preferably has a magnetized outer surface 255 such that the needles 60 will be engaged thereby. The drum 250 will preferably be a hollow iron drum, although a solid cylindrical member could be used, and will be magnetized in a conventional manner, for example by a permanent magnet or electromagnet 251 positioned against the inner surface 256 of the drum 250, or multiple magnets 251. Upon contacting the outer magnetized surface 255 of the drum 250, the needles 60 are magnetically engaged by the outer surface 255 and rotate with the drum 250 while the media 40 and processing aids 80 fall away and are directed onto the surface of a conventional rare earth magnet 230 and past a conventional metal detector 240 and finally to a media collection tray 260. The outside surface 255 of the drum 250 is then sprayed with water 290 by spray units 280 to rinse away any residual media 40 or processing aids 80. Needles 60 are then preferably removed from the outer drum surface 255 by retracting or deactivating the permanent or electromagnets 251 from the inner drum surface 256 thereby demagnetizing the outer drum surface 255. Then, the needles 60 are collected in needle collection tray 300, and water 290 is drained away. Another way to remove needles 60 from surface 255 is to use a scraper bar or member to mechanically disengage needles 60 from surface 255.

As mentioned above, once the media 40 and processing aids 80 are separated from the needles 60, the mixture is passed over a fixed rare earth magnet 230. The magnet 230 captures any needles 60 or metal pieces which may not have reached or been engaged by the rotating drum surface. The mixture then passes through a sensitivity adjustable conventional metal detector 240 to determine whether full separation has occurred. In the event that full separation has not occurred, the collected materials may then be recycled into the hopper 200 for reprocessing. The water 290 and slurry, which are separated from the grinding media 40, are accumulated and treated in various conventional manners, e.g., a multi-tiered decanting system. The decanting system then empties into a conventional sewage system.

The separation process of the present invention provides for a novel way of removing needles 60 from a slurry of grinding media 40 and processing aids 80 in a quick, efficient and cleanly manner such that the needles 60 are separated and cleaned while the abrasive media 40 is similarly separated and may be recycled in the blunt tip needle manufacturing process of the present invention. The needle separation process of the present invention has many advantages. It is possible to efficiently remove needles from the abrasive media in comparison to other separation techniques including manual separation. It is less costly to separate needles when compared to conventional methods, and it is now possible to achieve faster separation of needles in comparison to conventional methods.

The following example is illustrative of the principles and practice of the present invention although not limited thereto.

EXAMPLE

Figure 2:
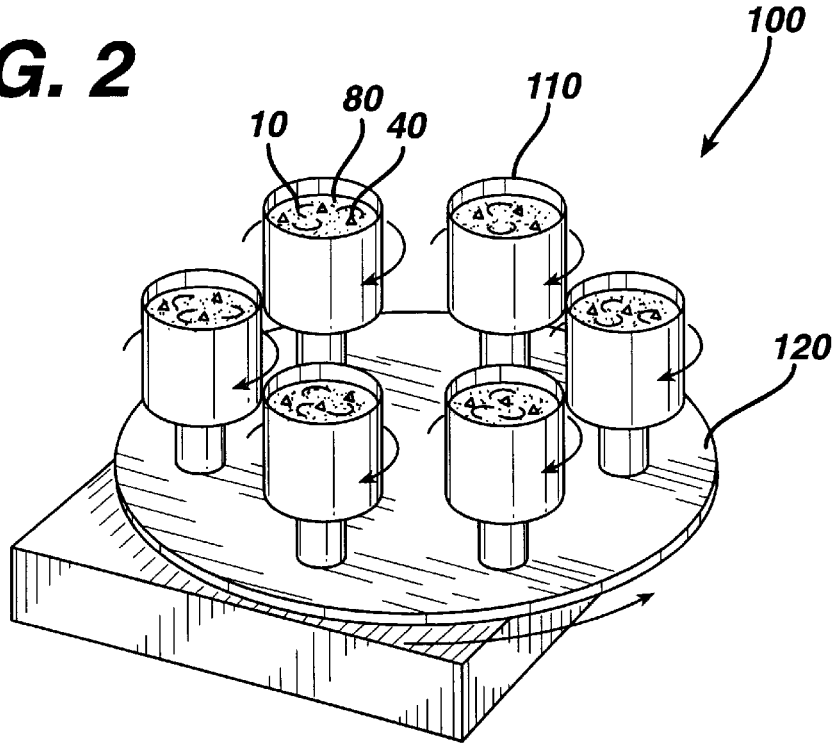
FIG. 2 is a perspective view of a process apparatus useful in the process of the present invention.

A lot of about 3,000 taper point surgical needles 10 having pointed piercing tips was loaded into an orbital grinding/mixing grinding apparatus 100 as illustrated in FIG. 2 having six barrels 110. The barrels 110 contained an abrasive media 40 as illustrated in FIG. 3C. The following types and amounts of processing aids 80 were charged to each barrel 110 of the apparatus 100: water (about 1.0 liters) and aluminum oxide (about 5.6 kilograms). The apparatus 100 was manufactured by Harper, Inc., of Meriden, Conn. The needles 10 had a wire size of 0.39" and a length of about 1.500". The needles 10 were made from Type 420 stainless steel alloy. The needles 10 had conventional taper point piercing tips 11. The abrasive media 40, having a triangular cross-section as seen in FIG. 3C., consisted of abrasive porcelain members loaded up to 50% by volume of the apparatus 100's capacity. The size of the media 40 was about ⅛"×⅛"×⅛"×0.75". The grinding apparatus 100, as mentioned previously, consisted of six tumbling barrels 110 mounted on an orbital drive 120. The apparatus 100 functioned in the following manner: the six barrels 110 containing processing aids 80, abrasive media 40 and needles 10 were rotated in a clockwise direction while orbiting a central drive shaft in a counterclockwise direction to provide an average "g" force of about 16.0.

The needles 10 were processed in the apparatus for about 30 minutes, sufficient to contact the grinding media 40 with the needles 10 to effectively produce blunt tip needles 60 having the desired profile (i.e., tip 65). The profile produced can be described as a tip radius of about 0.006" to about 0.008". The needles 60 were then removed from the apparatus 100 and separated from the grinding media in the following manner as illustrated in FIG. 8. The finished blunt tip needles 60, abrasive media 40 and processing aids 80 were moved from apparatus 20 and loaded into conically shaped hopper 200. The needles 80, abrasive media 40 and processing aids 80 were then discharged in a metered fashion to conventional vibrating feeder 210, and transferred to a second optional vibrating feeder 220. Vibrating feeder 220 fed the needles 60, media 40 and processing aids 80 to the magnetized exterior surface 255 of rotating drum 250. Upon contacting the outer magnetized surface 255 of the drum 250, the needles 60 were magnetically engaged by the outer surface 255 and rotated with the drum 250 while the media 40 and processing aids 80 fell away and were directed onto the surface of a conventional rare earth magnet 230 and past a conventional metal detector 240 and finally to a media collection tray 260. The outside surface 255 of the drum 250 was then sprayed with water 290 by spray units 280 to rinse away any residual media 40 or processing aids 80. Needles 60 were then removed from the outer drum surface 255 by retracting permanent magnet 251 from the inner drum surface 256 thereby demagnetizing the outer drum surface 255. Then, the needles 60 were collected in needle collection tray 300 and any water 290 was drained away. The water 290 and slurry which were separated from the grinding media 40, were accumulated and treated in a multi-tiered decanting system.

Inspection of the needles 60 revealed that the sharp taper point piercing tips 11 had been converted to blunt tips 65 having a radius of about 0.006" to about 0.008". The radii of the needles 60 varied as illustrated in the Table.

TABLE

| TIP RADIUS ANALYSIS | |
|---|---|
| DATA PTS. | = 75 |
| MEAN RADIUS | = .0045" |
| MIN VALUE | = .0038" |
| MAX VALUE | = .0060" |
| PREDICTED OUT OF SPEC VALUES | = 0 |
| CPK INDEX | = 1.97 |
| CP INDEX | = 2.36 |

The process of the present invention for manufacturing blunt tip surgical needles is seen to have numerous advantages when compared with the processes of the prior art. The process does not utilize cutting tools to produce blunt tips, accordingly, the process is not sensitive to set-up variations. Typically, in a conventional process, the manufacturing machines must be adjusted for different needle radii, raw materials and cutting tools. The process is also independent of the configuration of the taper point. It is possible to used needles with damaged points and convert them into useable blunt tip needles. The process is independent of the types of alloys from which the needles are made. Another advantage of the present process is that blunt tips having smaller radii can consistently be produced with minimal dimensional variability when compared to conventional manufacturing processes.

Although this invention has been shown and described with respect to detailed embodiments thereof, it will understood by those skilled in the art that various changes in form and detail thereof may be made without departing from the spirit and scope of the claimed invention.

What is claimed is:

1. A method of manufacturing a surgical needle having a blunt tip, comprising placing at least one taper point surgical needle having a pointed piercing tip into an abrasive media;

contacting the needle with the abrasive media for a sufficient amount of time and thereby abrading the needle to effectively convert the pointed piercing tip into a blunt tip;

providing a rotating member having a smooth exterior surface, wherein said surface is magnetic;

contacting the abrasive media and at least one needle with the surface of the rotating member, thereby separating the needle from the media such that the needle is engaged by the magnetic surface.

2. The method of claim 1 further comprising the step of disengaging the needle from the magnetic surface.

3. The method of claim 1 wherein the rotating member has a cylindrical configuration.

4. The method of claim 1 wherein the rotating member is a hollow drum having an exterior surface and an interior surface.

5. The method of claim 1 wherein the rotating member additionally comprises a magnet.

6. The method of claim 5 wherein the drum is magnetized by engaging a permanent magnet to the interior surface.

* * * * *